US009744425B2

(12) United States Patent
Klevana et al.

(10) Patent No.: US 9,744,425 B2
(45) Date of Patent: Aug. 29, 2017

(54) TRAVEL COVER WITH A SWIVEL HANDLE

(71) Applicant: Dynamic Brands, LLC, Richmond, VA (US)

(72) Inventors: Leighton Klevana, Richmond, VA (US); Edward Miyashita, Glen Allen, VA (US)

(73) Assignee: DYNAMIC BRANDS, LLC, Richmond, VA (US)

( * ) Notice: Subject to any disclaimer, the term of this patent is extended or adjusted under 35 U.S.C. 154(b) by 442 days.

(21) Appl. No.: 14/313,103

(22) Filed: Jun. 24, 2014

(65) Prior Publication Data

US 2014/0367213 A1 Dec. 18, 2014

Related U.S. Application Data

(63) Continuation-in-part of application No. 13/181,564, filed on Jul. 13, 2011, now Pat. No. 8,794,409.

(51) Int. Cl.

| | |
|---|---|
| ***A63B 71/00*** | (2006.01) |
| ***A45C 5/14*** | (2006.01) |
| ***A45C 13/26*** | (2006.01) |
| ***A45C 13/28*** | (2006.01) |
| *A45C 3/00* | (2006.01) |

(52) U.S. Cl.

CPC ..... *A63B 71/0036* (2013.01); *A45C 5/14* (2013.01); *A45C 13/26* (2013.01); *A45C 13/262* (2013.01); *A45C 13/28* (2013.01); *A45C 2003/007* (2013.01); *Y10T 16/455* (2015.01)

(58) Field of Classification Search

CPC ..... A45C 13/262; A45C 13/26; A45C 5/14; A45C 2013/267; A45C 3/02

USPC ..... 190/115, 18 A, 26, 39, 116; 242/270, 242/301; 484/141, 62; 16/114.1, 445

See application file for complete search history.

(56) References Cited

U.S. PATENT DOCUMENTS

| | | | | |
|---|---|---|---|---|
| 2,605,989 A | | 1/1949 | Luft | |
| 2,784,816 A | | 3/1957 | Goldberg | |
| 4,876,416 A | * | 10/1989 | Frantz | H01H 19/585 200/11 DA |
| 5,813,504 A | * | 9/1998 | Iny | A45C 5/14 16/405 |
| 6,164,425 A | | 12/2000 | Latshaw | |
| 7,077,252 B2 | | 7/2006 | Sanchez | |
| 7,468,025 B2 | * | 12/2008 | Hauser | A63B 21/00047 482/141 |
| 7,775,334 B2 | | 8/2010 | Drew et al. | |

(Continued)

FOREIGN PATENT DOCUMENTS

| | | |
|---|---|---|
| ES | 2253093 | 8/2004 |
| GB | 2309203 | 7/1997 |

(Continued)

*Primary Examiner* — Fenn C Mathew
*Assistant Examiner* — Cynthia Collado
(74) *Attorney, Agent, or Firm* — Bernard G. Pike; Pike IP Law, PLLC

(57) ABSTRACT

A swivel handle capable of rotating or swiveling is disclosed. The swivel handle comprises a handle that is capable of rotating relative to a base plate or an enclosure or other object to be pulled. The swivel handle may further comprise a rotatable plate wherein the handle is connected to the rotatable plate, a rotational locking assembly, and/or a braking assembly.

7 Claims, 13 Drawing Sheets

(56) References Cited

U.S. PATENT DOCUMENTS

| | | | | |
|---|---|---|---|---|
| 8,794,409 | B2 * | 8/2014 | Klevana | A45C 5/14<br>16/114.1 |
| 8,876,677 | B2 * | 11/2014 | Meininger | A63B 21/00076<br>482/131 |
| 9,168,785 | B2 * | 10/2015 | Spektor | B60B 33/0076 |
| 9,616,313 | B2 * | 4/2017 | Townsend | A63B 71/0036 |
| 2005/0085352 | A1 * | 4/2005 | Baxter | A63B 21/0724<br>482/100 |
| 2005/0126873 | A1 | 6/2005 | Matsumoto | |
| 2006/0076203 | A1 | 4/2006 | Miller | |
| 2007/0252353 | A1 | 11/2007 | Sokol | |
| 2008/0202872 | A1 * | 8/2008 | Huang | B60T 7/085<br>188/171 |
| 2010/0210431 | A1 * | 8/2010 | Hinton | A63B 21/00047<br>482/141 |

FOREIGN PATENT DOCUMENTS

| | | |
|---|---|---|
| WO | WO2005105546 | 11/2005 |
| WO | WO2008135974 | 11/2008 |

* cited by examiner

TRAVEL COVER WITH A SWIVEL HANDLE

RELATED APPLICATIONS

This application is a continuation-in-part application claiming priority under 35 U.S.C. §120 from U.S. patent application Ser. No. 13/181564 filed on Jul. 13, 2011.

FIELD OF THE INVENTION

The invention is directed to luggage and travel covers for carrying sports equipment or other objects that need protection during transportation. Embodiments of the travel covers comprise at least one wheel and a handle that is configured to swivel to provide ease and ergonomic handling of the travel cover.

BACKGROUND

Luggage, duffel bags, travel bags and travel covers including travel covers for sporting goods such as, but not limited to, golf bags, skis, snowboards, baseball/softball equipment, soccer equipment, football equipment, lacrosse equipment, hockey equipment, bowling equipment, motocross equipment, and tennis equipment, and travel covers for tradeshow or conference displays or graphics, product samples, tents (collectively, "travel covers"), for example, are commonly used for conveniently transporting and protecting large objects during travel by walking, car, train and/or airplane.

Luggage may have wheels to assist in moving the luggage and its contents. Typical wheeled luggage also has a retractable handle that may be moved between a storage position and an extended position. The handle is pulled out of the storage position into the extended position to increase the overall length of the luggage so it may more easily be rolled. The extended position prevents the user from having to bend over to hold the handle when the luggage is in a tilted position that allows the luggage to roll. Thus, the extended position avoids fatigue and injury to the user.

Some wheeled travel covers, however, are sufficiently long so they do not require a retractable handle. These long travel covers typical have handles attached to the top portion of the travel cover. The handle is attached directly to the enclosure, typically sewn on, and does not swivel relative to the travel cover. The handle is usually attached in a horizontal position that may be uncomfortable to the user of the travel cover but is a compromise position for pulling the travel cover with the right or left hand.

There exists a need for a travel cover with a swivel handle that is attached directly to the enclosure of the travel cover and that swivels. There exists a further need for a travel cover in which the enclosure does not comprise a retractable handle but has a swivel handle.

SUMMARY

Embodiments of the invention are directed to a travel cover with a handle capable of rotating or swiveling. The travel cover comprises an enclosure for protecting and facilitating transporting objects during travel. For example, embodiments of the travel cover comprise an enclosure, a base plate connected to the enclosure, and a handle rotatably connected to the base plate. The travel cover may further comprise a rotatable plate wherein the handle is connected to the rotatable plate. The base plate and the rotatable plate may be any size or shape capable of supporting and connecting the swivel handle on the enclosure. In some embodiments, the base plate or rotatable plate may cover more than fifty percent (50%) of the top portion of the travel cover.

Further embodiments of the travel cover may comprise a housing having a surface defining an aperture, wherein the handle or a portion of the handle protrudes through the aperture and the surface covers a periphery portion of the rotatable plate. The housing may be connected to the enclosure directly or connected to a base plate.

A still further embodiment of the travel cover comprises an enclosure, a housing for the swivel handle, a rotatable plate directly or indirectly connected to the enclosure, the rotatable plate comprising a first side facing toward the enclosure and a second side facing away from the enclosure, and a bearing contacting a bearing surface on the second side of the rotatable plate and a bearing surface on an inside surface of the housing. The swivel handle may comprise more than one bearing to facilitate rotation of the handle.

Other aspects and features of embodiments of the travel covers comprising at least one swivel handle will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more particular embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DESCRIPTION OF EMBODIMENTS

Figure 1:
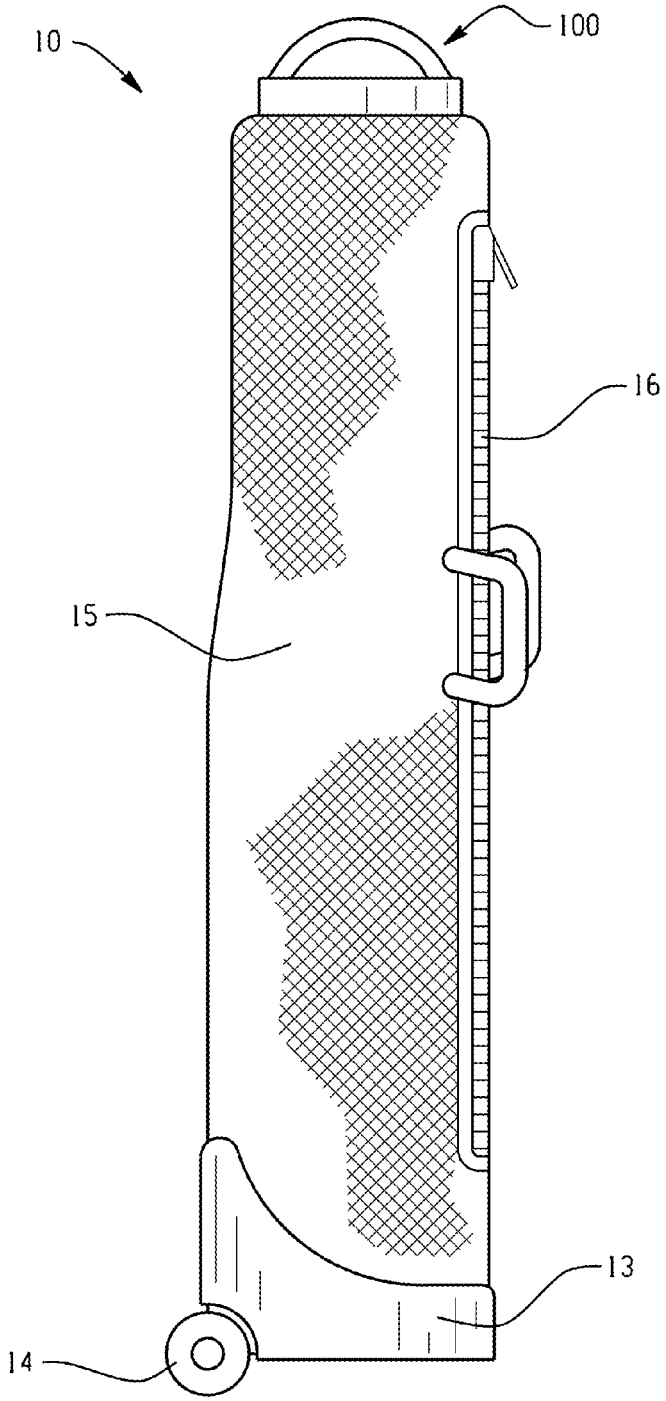
FIG. 1 depicts a travel cover.

Travel covers are used to protect a variety of objects during transport including traveling by walking, car, train and/or airplane as previously described. For example as shown in FIG. 1, a golf bag travel cover may be used to protect a golf bag and golf clubs. Golf bag travel covers are typically used by golfers to protect and ease transporting their golf clubs on airplanes where the bags must be carried through the airport. There is a significant chance of damage to the golf clubs as they are put in a trunk of a car, carried through an airport, and loaded into and transported in a baggage compartment of a train or airplane. These covers have tough enclosures that protect golf bags and other objects to be transported. The enclosures of travel covers may be flexible, rigid, or have components that are rigid and components that are flexible. For example, the embodiment of the golf bag travel cover 10 shown in FIG. 1, includes a rigid base member 13, a pair of wheels 14, a flexible cover 15, and means for closing 16 the flexible cover 15. The means for closing may be selected from the group comprising, but not limited to, zippers, hook and loop closures, buckles, snaps, ties, buttons and/or a combination of such closures. The embodiment of the golf bag travel cover further comprises a swivel handle 100. The swivel handle 100 may rotate to allow ergonomic pulling or pushing of the travel cover by a traveler to the car, through the airport or hotel, to the golf course, as well as anywhere else.

In the embodiment shown in FIG. 1, the base member 13 allows the golf bag travel cover 10 to stand upright and comprises at least one wheel 14 for rolling the travel cover when the travel cover 10 is in the tilted position. The travel cover 10 may be leaned forward to shift the weight onto the wheels 14 and held by the handle 100 on the top portion of the travel cover 10. The travel cover 10 may be easily pulled as a portion of the weight of the travel cover and its contents is supported by the wheels 14 and only a portion of the weight may be supported by a handle by the user. However, as the travel cover 10 is transferred from the user's left hand to the right hand, for example, the swivel handle 100 may adjust by rotating to a comfortable position for the user's hand in the new position. It is ergonomic for the swivel handle 100 to rotate from tilting from a comfortable position for the right hand to a comfortable position in the left hand. The swivel handle 100 may also adjust to reduce stress on the hand, wrist, and/or arm of the user as the travel cover is pulled up stairs, turned around corners or when tilting the travel cover from an upright position to a rolling, tilted, or laying position.

Embodiments of the swivel handle and components of the swivel handle may be made using any material or combination of materials that provides the desired properties to the components. Example materials include plastics such as, but not limited to, ABS, polyethylene, high density polyethylene, polypropylene, or other plastics and metals including, but not limited to, aluminum, steel, stainless steel, or combinations of such materials, for example. Similarly, the flexible portion, if present, may be made using any desired material such as, but not limited to, nylon or other fabric.

As previously stated, typical luggage having wheels will also comprise a retractable handle. The retractable handle may be withdrawn to increase the overall height of the luggage and extend the handle to a more ergonomic height for pulling the luggage on the wheels. With the handle extended, the luggage may be leaned forward with a portion of the weight still supported by the wheels but the user's arm may be comfortably extended to pull the luggage. However, some travel covers are already at sufficient length that the travel cover does not require a retractable handle to extend their overall height. Typically, retractable handles may be extended to increase the overall height of the luggage to the range of about three feet to about four feet. Embodiments of travel covers comprising wheels that have an overall length over three feet may comprise a non-retractable handle fixed handle. Other embodiments of the travel cover having an overall length of three and one half feet or greater, or even four feet or greater may not have a retractable handle. These embodiments of travel covers may comprise a non-retractable handle that is typically fixed to a top portion of the travel cover.

Embodiments of the travel cover comprising a non-retractable handle capable of swiveling about an axis during use. Components of an embodiment of the swivel handle 100 capable of swiveling are shown in FIG. 2.

The rotatable plate may be any portion or component connected to the handle that is used to rotatably connect the handle to the top portion of the enclosure. In the embodiment shown in FIG. 2, the rotatable plate is a circular plate that rotates within the housing. However, the rotatable plate is not required to be complete circle, for example, the rotatable plate may be an annular ring; two small place plates attached, one attached to each end of the handle, a plate extending between both ends of the handles, as well as generally triangular, square, rectangular, oval or other shapes.

The rotatable plate may be sandwiched between the other components of the travel cover such as between any combination of a housing, a bearing, fixed or nonrotatable plate, the enclosure, or two of the same types of components. The rotatable plate may also be rotatably connected by an axle, center shaft or central connector. The axle, center shaft or central connector may further include a bearing. Thus, the rotatable plate may be rotatably connected to the travel cover by its center, its periphery, or both. In any case, the bearings may be integral or separate from another component.

Figure 2:
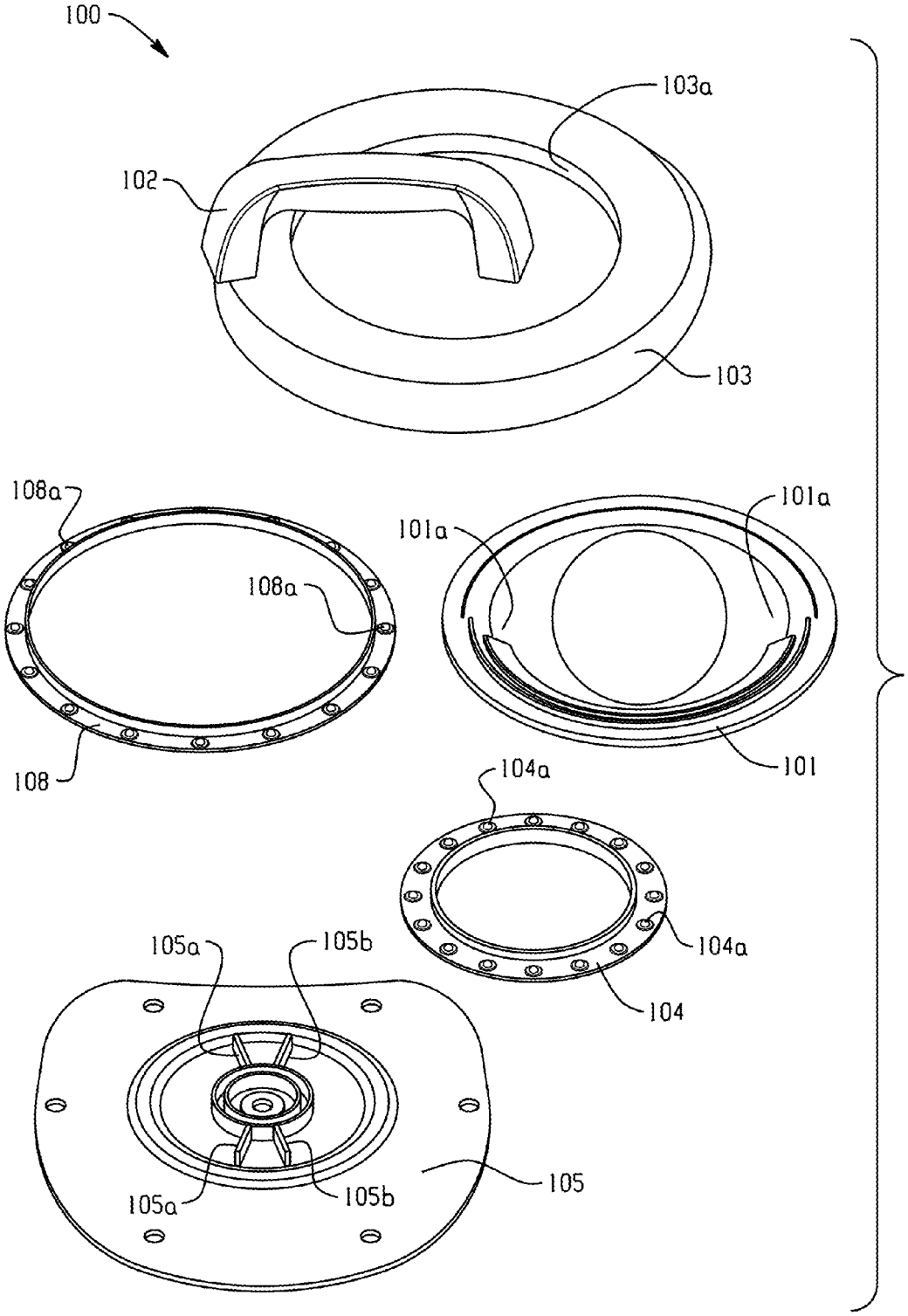
FIG. 2 depicts components of an embodiment of a travel cover comprising a swivel handle including an upper bearing 108, rotatable plate 101, lower bearing 104, base plate 105, housing 103 and handle 102.

As in the embodiment shown in FIG. 2, the swivel handle 100 may comprise a base plate 105 capable of being connected to an enclosure (not shown) and a rotatable plate

Figure 4:
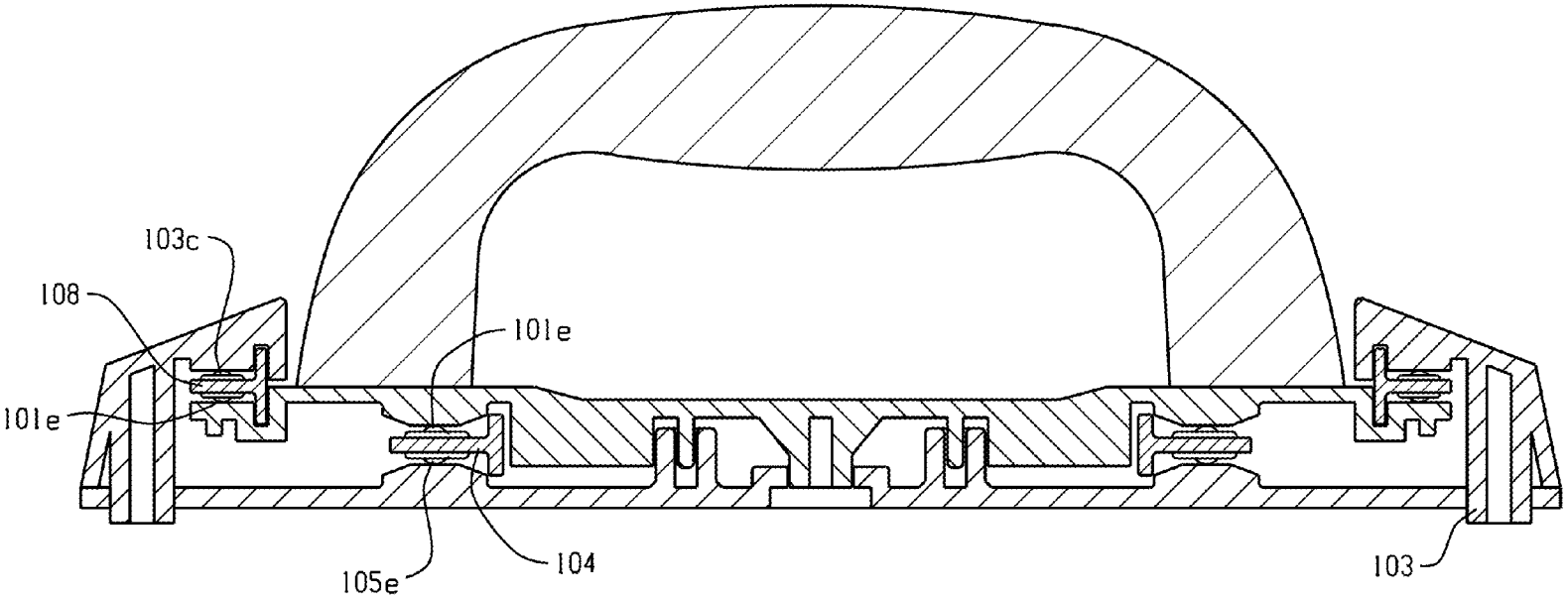
FIG. 4 depicts a cross-sectional view of the embodiment of the swivel handle of FIG. 3 with a housing.

101 rotatable relative to the base plate 105. The rotatable plate 101 comprises a handle 102. The handle 102 may be integral to the rotatable plate 101 or connected separately of the rotatable plate 101. Embodiments of the handle may have at least one connection point; in some embodiments, the handle 102 comprises two points of connection as shown in FIG. 2. The rotatable plate 101 may be disposed between a housing 103 and the base plate 105. The housing 103 may be connected to the base plate 105 along a periphery and defines an aperture 103*a* through which the handle 102 may be disposed. In other embodiments, the house 103 may be connected directly to the enclosure or to an inner plate inside the enclosure. In such an embodiment, the base plate 105 may be independently connected to the enclosure 15 or merely held in place by the housing 103. The rotatable plate 101 may rotate within the space between the base plate 105 and the housing 103. With the handle protruding through the aperture 103*a* in such cases, the handle 102 may be easily grasped and swivel within the housing 103. In certain embodiments, the housing may have a surface defining the aperture 103*a*, wherein the handle protrudes through the aperture 103*a* and the surface covers a periphery portion of the rotatable plate. A bearing 108 may be disposed between the covered periphery portion of the rotatable plate 101 and an inside bearing surface 103*c* (See FIG. 4) of the housing 103.

As such, in further embodiments, the swivel handle 100 may comprise one or more bearings. The bearings are capable of improving the ability of the swivel handle 102 to rotate within the housing 103. The bearings may be located on a central axle 106, between the housing 103 and the rotatable plate 101, and/or between the base plate 105 and the rotatable plate 101. The bearings may take any desirable form including slide bearings and/or roller bearings. The roller bearings may be ball bearings or wheel bearings, for example. The swivel handle may further comprise springs capable of biasing or urging a component of the swivel handle toward or away from the bearing. Since the handle is used to pull the travel cover and its contents, an embodiment of the travel cover comprises a bearing between the rotatable plate and the housing or other component on the opposite side of the rotatable plate from the enclosure.

The embodiment of the swivel handle 100 shown in FIG. 2 has a ball bearing 104 having a plurality of balls 104*a*. In the embodiment of the swivel handle 100 shown in FIG. 2, the bearing 104 is disposed between the base plate 105 and the rotatable plate 101. The swivel handle shown in FIG. 2 further comprises a bearing 108 disposed between the rotatable plate 101 and the housing 103. The bearing 108 comprises ball bearings 108*a* that may roll along bearing surfaces on the housing 103*c* and the rotatable plate 101*e*. The bearing 108 may comprise a lower extension 108*b* that may engage a groove in the rotatable plate 101 or may comprise an upper extension 108*c* that engages a groove on the housing 103 or may comprise both extensions 108*b* and 108*c* to stabilize the bearing 108 during rotation of the handle.

Similarly, the bearing 104 may comprise balls 104*a*. The balls 104*a* may roll on the bearing surface 101*e* on the rotatable plate and 105*e* on the base plate 105. Additional embodiments may comprise bearings in other locations such as on a central axle. Further, embodiments of the swivel handle may comprise only one of the bearings described above, all of the bearings or any combination of bearings. The upper bearing 108 facilitates swiveling of the handle while the handle is being pulled to roll or otherwise move the travel cover.

Figure 5:
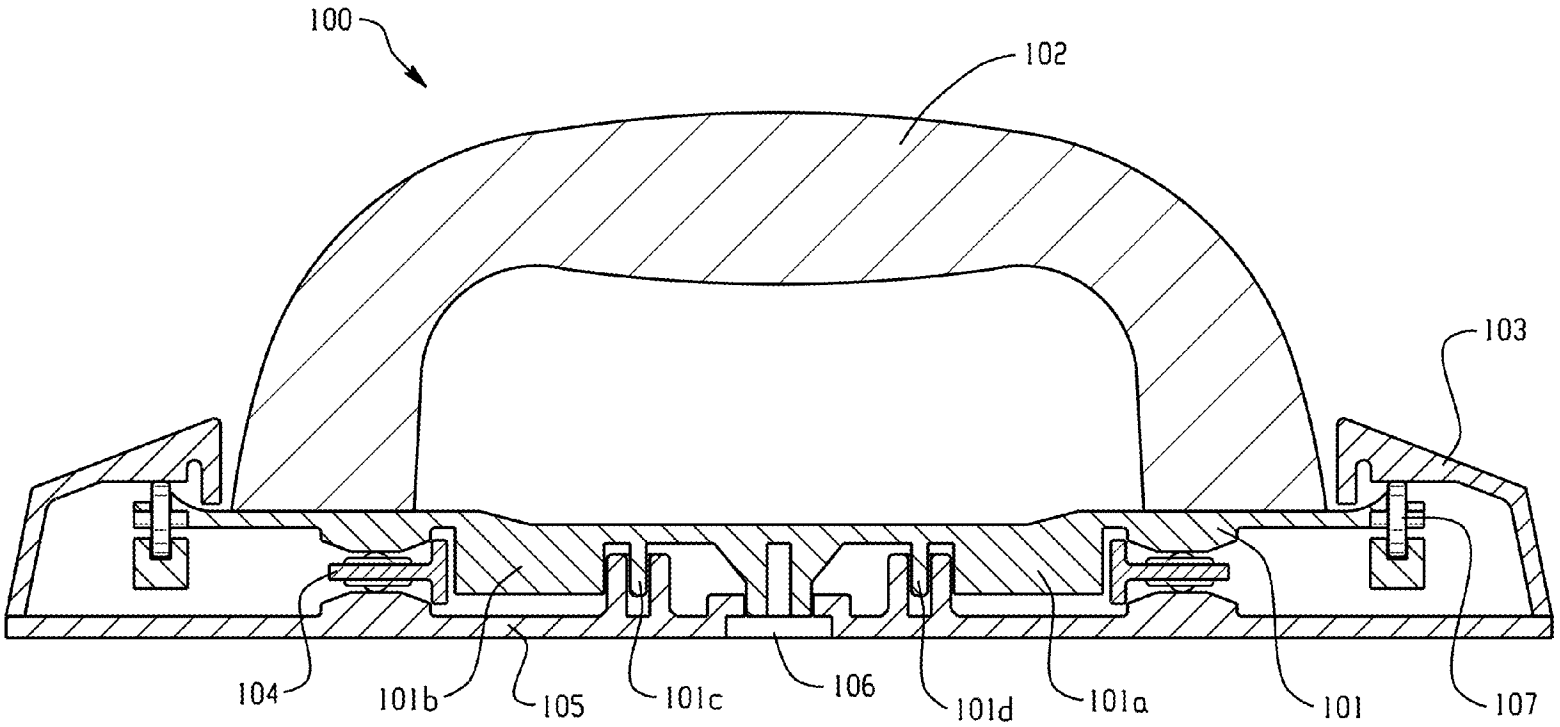
FIG. 5 depicts a cross-sectional view of another embodiment of the swivel handle wherein one set of bearings is a set of wheels connected to the rotatable plate.

Further, in the embodiment of the swivel handle of FIG. 5, the swivel handle may comprise a bearing comprising a set of wheels 107 between the rotatable plate 101 and the housing 103. The bearing 107 may be used in combination with the bearing 104 between the base plate 105 and the rotatable plate 101. In the embodiment of the travel cover shown in FIG. 5, the bearing comprising wheels 107 comprises at least three wheels rotatably connected to the rotatable plate 101, and preferably at least four wheels. The wheels 107 may be connected to the rotatable plate 101 and roll along a bearing surface on the inside of the housing 103. Thus as the travel cover is pulled, the rotatable plate 101 is pulled toward the housing 103 and the bearing 107 or bearing 108 allows the rotatable plate 101 to still easily rotate within the housing 103. In a still further embodiment, the rotatable plate 101 may be further rotatably connected to the base plate 105 by an axle 106. The axle 106 may comprise a bearing fixedly connected to the either of the base plate 105 and/or the rotatable plate 101.

Figure 3:
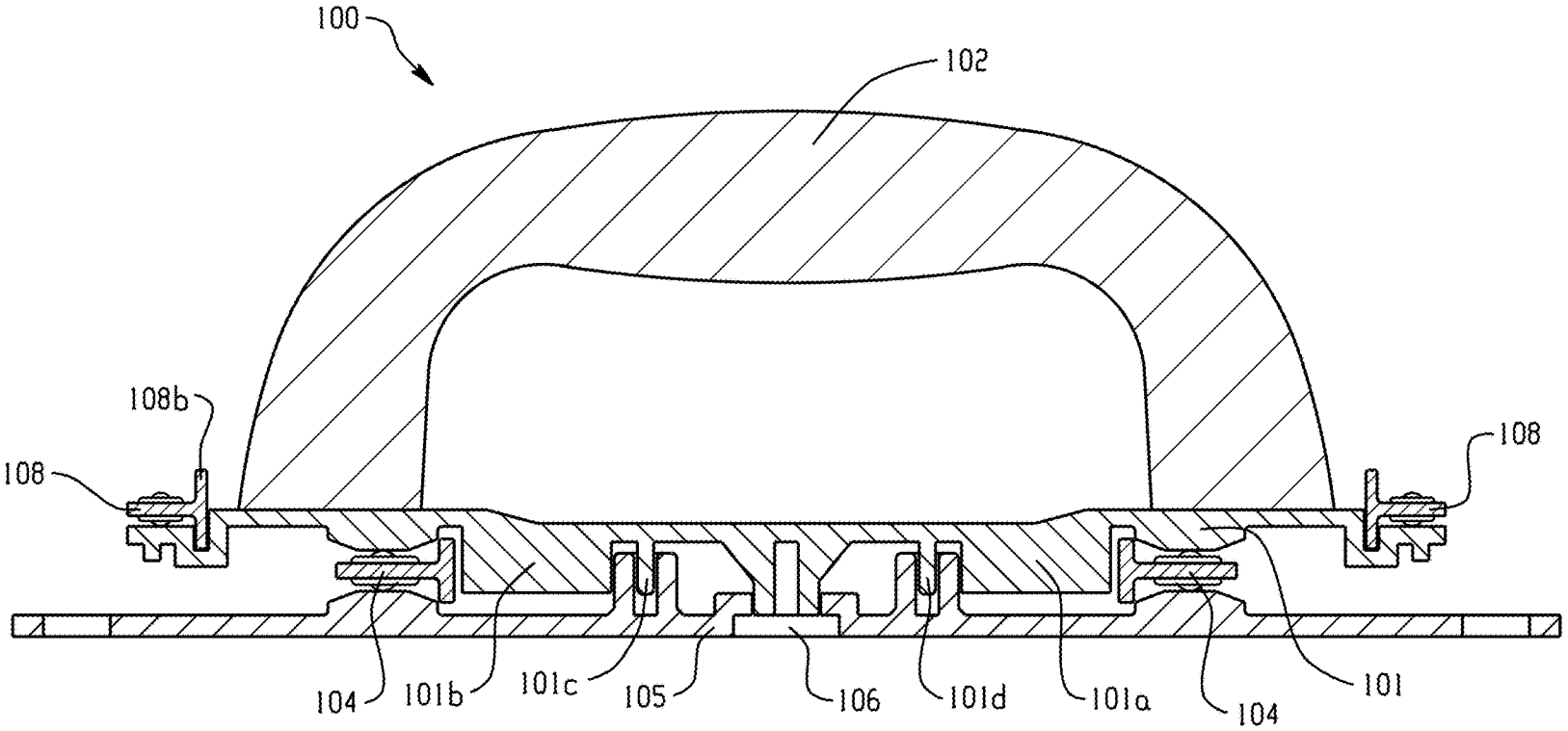
FIG. 3 depicts a cross-sectional view of an embodiment of a swivel handle without a housing.

In still further embodiments of the travel cover, the handle 102 may swivel completely around or the rotation of the handle 102 relative to a base plate 105 or the top portion of the travel cover may be limited by a combination of stops. For example, the base plate 105 and the rotatable plate 101 may comprise one or more stops that may engage one another during rotation. For example, the base plate 105 may comprise at least one stationary stop 105*a* and 105*b* and the rotatable plate may also comprise at least one rotatable stop 101*a* and 101*b*. The rotatable stop may engage the stationary stop as the handle 102 is rotated to limit further rotation of the rotatable plate relative to the base plate. In certain other embodiments, the base plate 105 may comprises two stationary stops that engage at least one rotatable stop to limit the rotation of the rotatable plate 101 in each of two directions relative to the base plate 105. The positioning of the steps may be reversed or in another configuration capable of limiting the rotation of the handles. The combination of stops interferes with the rotatable plate's 101 rotational movement to limit the rotation of the rotatable plate 101 to less than 360°. For example, in the embodiment of the swivel handle 105 in FIG. 2, the four stops 105*a* and 105*b* are integrally formed in the base plate 105. There are two corresponding stops on the bottom portion of the rotatable plate 101 (an example is shown in FIG. 3, stops 101*a* and 101*b*) that may rotate within the angle A. This combination of stops on the base plate 105 and the rotatable plate 101 limits that angular rotation of the swivel handle 102 within a desired range. For example, in certain embodiments of the swivel handle, the angular rotation of the handle may be limited to less than 360°. In other embodiments such as the embodiment of the swivel handle shown in FIGS. 2 and 3, the angular rotation A of the swivel handle 102 is limited to less than 180° and other embodiments may limit the angular rotation to less than 140°.

Further embodiments of the swivel handle may comprise a guide system for supporting and guiding the rotational movement of the swivel handle. For example, the base plate 105 and the rotatable plate 191 or the housing 102 and the rotatable plate 101 may comprise interlocking components that guide the rotational movement of the swivel handle 102. In the embodiments of the swivel handle shown in FIGS. 2 and 3, the base plate 105 comprises an inner ring 105*c* and an outer ring 105*d* defining an annular space between the two rings. The rotatable plate 101 comprises at least one corresponding protrusion 101*c* and 101*d* (see FIG. 3) that may be inserted in the annular space between the inner ring 105*c* and the outer ring 105*d*. The annular space will restrict the movement of the protrusion or protrusions 101*c* and/or 101*d* within a distinct range. The protrusion may be any shape including a pin, post, arc or complete circle. As one skilled in the art would understand, these features may be switched from the components shown in FIGS. 2 and 3 to the other components and still function as required.

To connect the swivel handle 100 to the enclosure 15, the base plate 105 or the housing 103 may be connected to the enclosure 15. The base plate 105 or housing 103 may be connected to the enclosure around their periphery. The base plate 105 and/or the housing 103 may be connected to the enclosure 15 by any attachment mechanism including, but not limited to, rivets, screws, bolts, adhesives, glues, stitching, or other connector. The base plate or housing may be connected directly to the top of the enclosure or may have intermediate components between the base plate or housing and the enclosure. Alternatively, if the top portion of the travel cover is a rigid material a top portion of the travel cover may act as the base plate and comprise the desired configuration. As such, the base plate 105 may be integral to the top of the enclosure of the travel cover.

Further, the swivel handle may comprise a second plate (not shown). The second plate may be installed on the inside of the enclosure. In such an embodiment, the base plate 105 may be connected to the second plate by rivets, screws, bolts or stitching to provide a more rigid support for the swivel handle 100 to the travel cover 100. A second plate may be desirable for travel covers comprising a flexible top portion or, in some cases wherein the travel cover has a rigid top portion. If the top portion or the entire travel cover comprises a rigid material, such as a rigid plastic, the second plate internal to the enclosure may not be as desirable, except in embodiments where extra support is needed for carrying and supporting heavy contents.

For some travel covers such as golf bag travel covers, there may be advantages for the travel cover to comprise a rigid top portion. Particularly, for embodiments of the travel covers for golf bags comprising golf clubs, the top portion of the travel cover may comprise a rigid top portion. The rigid top portion provides additional protection against damage during transport to the golf clubs that extend beyond the top of the golf bag. There may be other applications for travel covers that comprise a flexible portion and a rigid top portion. Other travel covers may comprise a complete rigid enclosure, for example, travel covers for tradeshow or conference displays or graphics and/or product samples may benefit from the protection provided by a rigid enclosure.

In some instances, the user of the travel cover may wish to reduce the rotational speed or prevent the rotation of the rotatable plate relative to the housing. For example, the travel cover may be more maneuverable at times with the swivel handle fixed in a locked position while maneuvering around obstacles or roll the travel cover down a curb. Therefore, embodiments of a swivel handle may comprise a brake member that slows the rotational speed of the rotatable plate relative to the housing or a locking member that fixes the relative position of the rotatable plate and the base plate or the housing. The brake member a brake member may be slidingly connected to the handle and moveable between a released position and a braking position. The brake member may be biased toward the released position by a biasing member. The biasing member may be a spring or elastic member. The brake member may be moved from the released position to the braking position by overcoming the biasing force. In the braking position the brake member contacts one of the base plate or the housing to increase the friction between the rotatable components and the stationary components.

Figure 6:
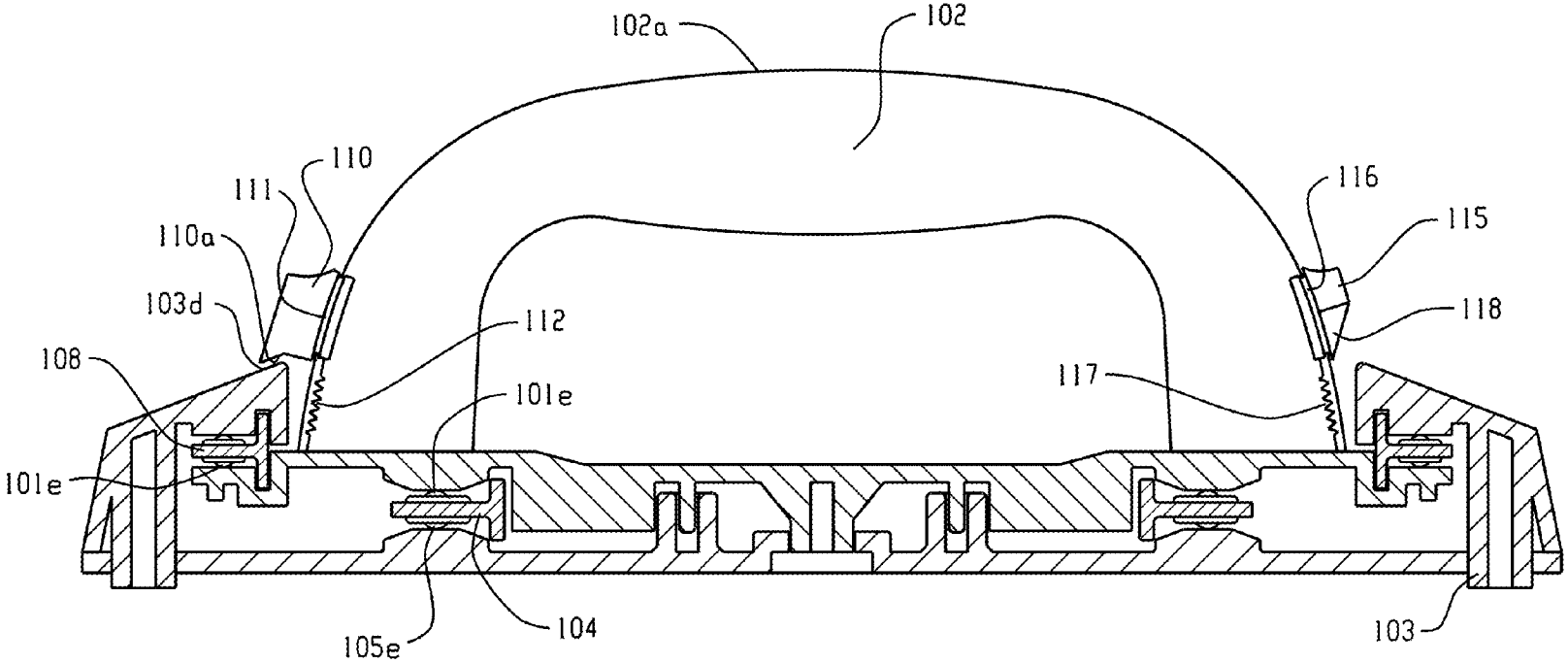
FIG. 6 depicts a cross-sectional view of an embodiment of the swivel handle comprising a brake member, wherein the brake member is slidingly connected to the handle and moveable between a released position and a braking position, wherein the brake member is biased toward the released position and in the braking position the brake member contacts or the housing and an embodiment of the swivel handle comprising a locking assembly capable of selectively moving between a locking position fixing the relative positions of the rotatable plate relative to the base plate.

One embodiment of the swivel handle comprising a brake member is shown in FIG. 6. A brake member 110 is slidingly connected to the handle 102. The brake member 110 defines a groove 111 in its side wall. The shell 102*a* of the handle 102 is received within the groove 111 to slidingly connect the brake member 110 to the handle 102. The brake member 110 is biased toward the released position by a biasing member, spring 112. The brake member 110 may be moved from the released position to the braking position by the user to contact a brake surface 110*a* of the brake member 100 with the upper surface 103*d* of the housing 103. In the braking position, the brake surface 110*a* contacts upper surface 103*d* to increase the friction between the handle 102 and the housing 103 to slow or stop the rotation of the handle 102 relative to the housing 103.

Also, an embodiment of a swivel handle comprising a locking assembly is shown in FIG. 6. A locking assembly may be used to temporarily lock (prevent rotation) the relative positions of the handle and the housing. A locking assembly may help control rotation of the swivel handle and the bag when it is used to transport heavy loads, fragile equipment, or for long distance walking when swiveling of the handle is less beneficial. In the locked position, the swivel handle operates as a traditional luggage handle. The embodiment of the swivel handle in FIG. 6 comprises a locking member 115. The locking member 115 defines a groove 116 in its side wall to moveably connecting the locking member, 115 to the housing 103. A portion of the shell 102*a* of the handle 102 is received within the groove 116 to slidingly connect the locking member 115 to the handle 102. The locking member 115 is biased toward the released position by a biasing member, spring 117. The locking member 115 may be moved from the released position (as shown) to the locked position by the user to move at least a forward portion 118 of the locking member 115 into a locking recess or detent 119 defined in the housing 103. See FIG. 9, for example.

Figure 9:
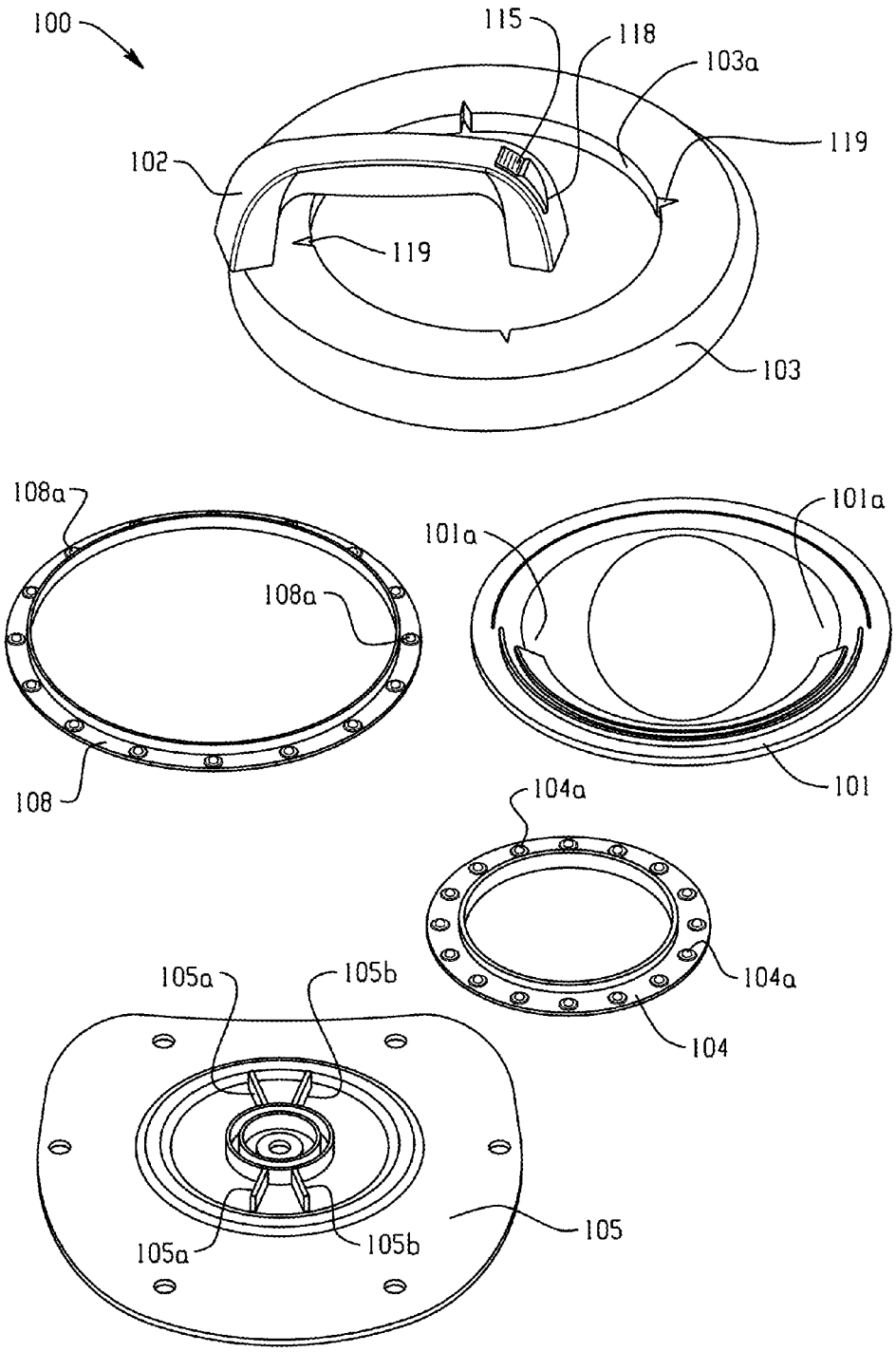
FIG. 9 depicts components of an embodiment of a travel cover comprising a swivel handle including a housing 103 comprising plurality of recesses defined in the housing, rotatable handle, and a brake member slidingly connected to the housing, wherein the brake member may be received within a recess to lock the position of the rotatable handle.

Another view of a swivel handle comprising a locking assembly is shown further in FIG. 9. The locking member 115 is moveably connected to the handle 102 such that the forward portion 118 may be received within any of the locking detents 119. The housing 102 is shown with four locking detents 119 located every 90° around the circumference of the housing 102. The housing may comprise more or less locking detents 119 as desired. For example, the housing may comprise 8, 16 or 32 locking detents to allow locking the handle 102 at a comfortable position. The entire inner circumference may be configured with locking detents 119 such that the handle 102 may be locked in any position. The locking member 115 may further comprise a switch that fixes the locking member 115 in the locked position. The switch may comprise a pin that may be removably received within an aperture, detent, or slot.

Figure 11:
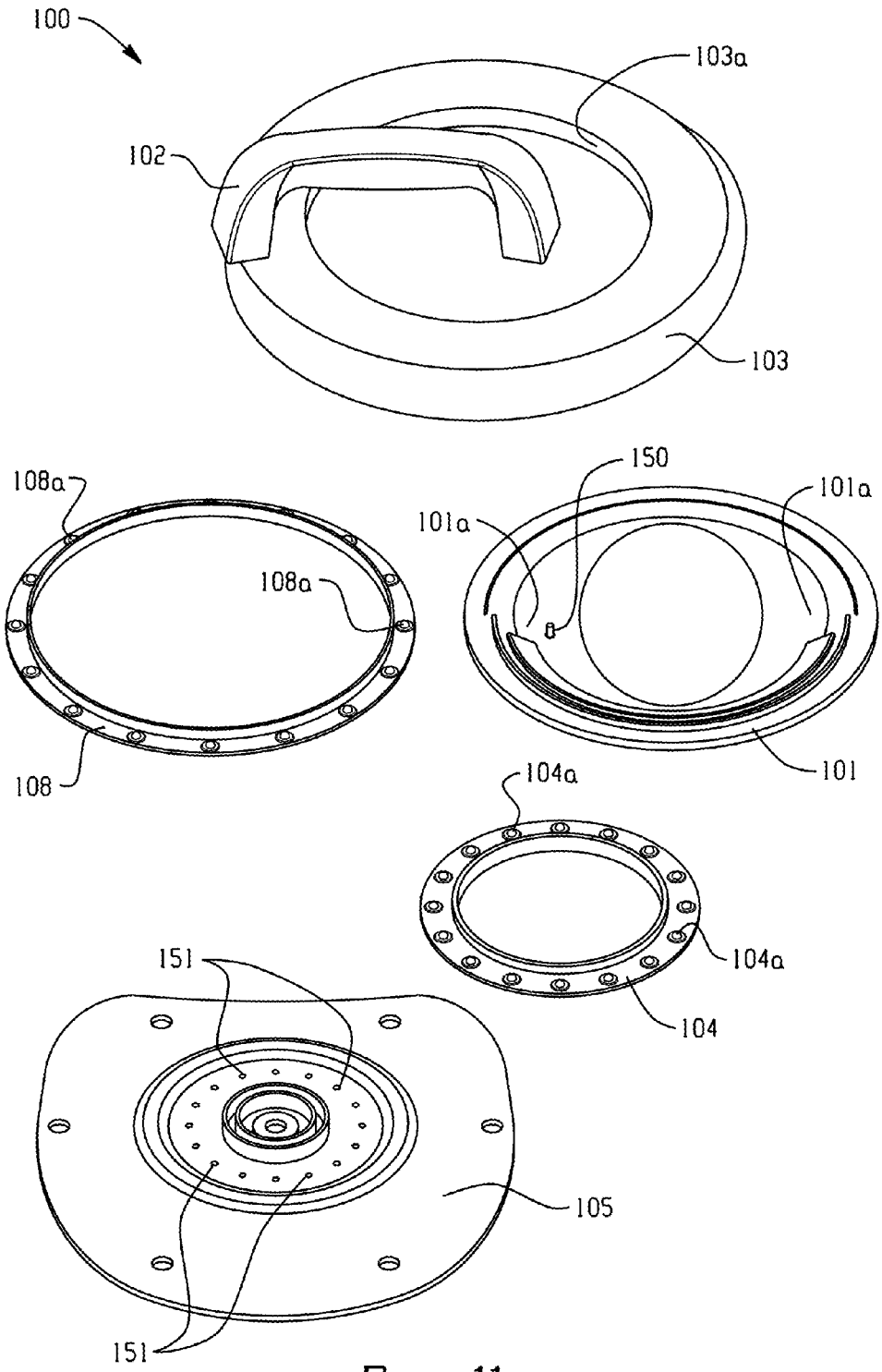
FIG. 11 depicts an embodiment of the swivel handle comprising a locking pin.

FIG. 11 depicts another embodiment of a swivel handle with a locking member, wherein the rotatable plate 101 comprises an extendable and retractable pin 150 that may be extended to be received within any of the plurality of apertures 151 in the base plate 105. The pin 151 prevents the relative rotation of the handle and the base plate.

In other embodiments, the locking member may not be biased toward the released position. For example, the locking member may comprise an over-center switch to change the locking member from the locked position to the released position. The locking member may comprise a protrusion and a detent or merely a high friction member such as rubber that firmly presses against another component of the braking assembly.

Figure 7:
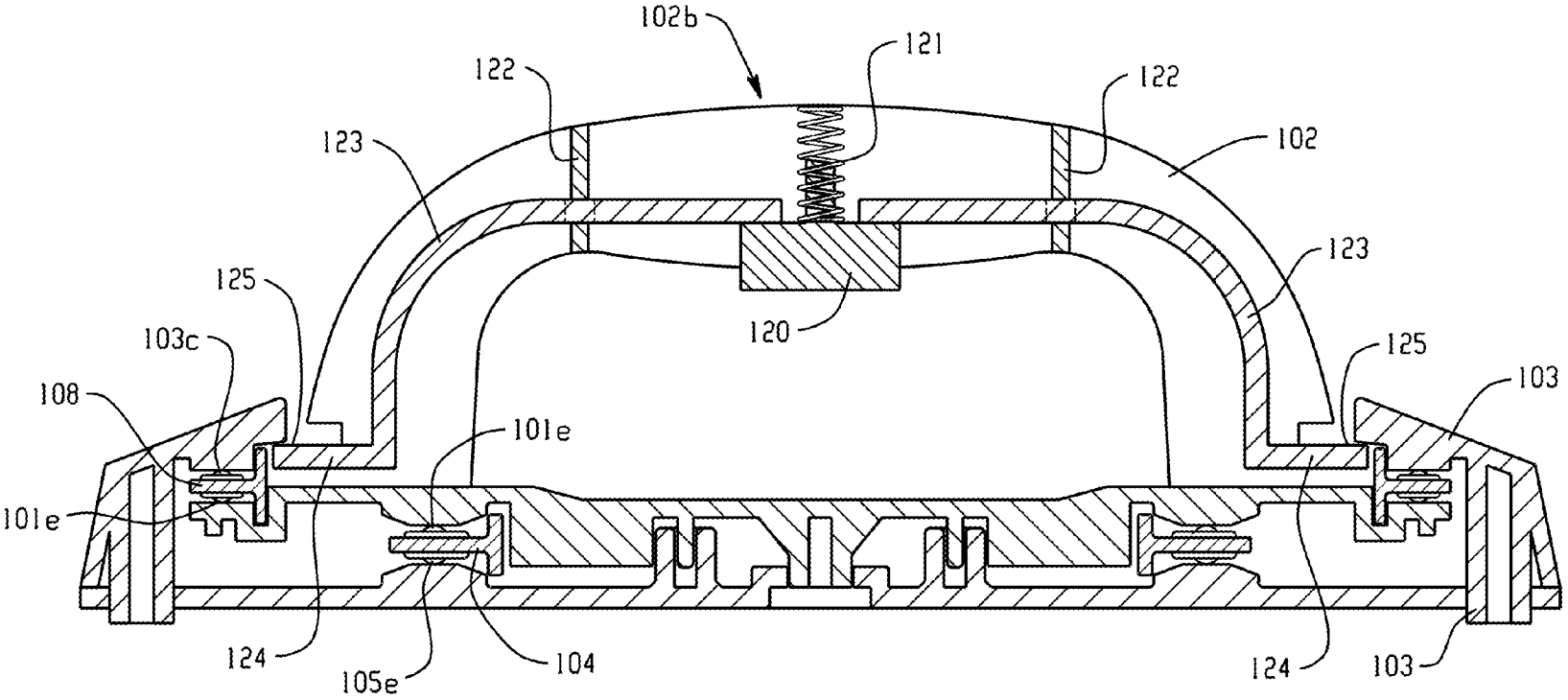
FIG. 7 depicts a cross-sectional view of another embodiment of the swivel handle comprising a brake member, wherein the brake member is slidingly connected to an underside of the handle.

Another embodiment of the swivel handle comprising a brake assembly is shown in FIG. 7. The brake assembly may be used to increase the rotational friction between the rotating components of the swivel handle and the stationary components. In this embodiment, the swivel handle 102 comprises a centrally located brake button 120 on the underside of grip portion 102*b* of the handle 102. The brake button 120 is biased toward the released position by at least on spring 121. The brake assembly comprises two arms 123 connected to the brake button 120. The brake arms 123 move with the brake button 120. In the embodiment shown in FIG. 7, the brake assembly comprises two posts 122 that guide the movement of the arms 124 by passing through apertures in the arms 123. The arms 123 comprise brake pads 124 that extend out of apertures on either end of the handle 102. In the braking position, the brake pads 124 contact an underside wall 125 of the housing 103 to slow the relative rotational movement between the rotational components and the stationary components of the swivel handle.

The embodiment of the brake assembly shown in FIG. 7 may be modified to be a locking assembly. In such an embodiment, the underside 125 of housing 103 may comprise locking recesses or detents such that the brake pads 125 are received with the locking recesses or detents and prevent rotation of the handle 102 relative to the housing 103.

Figure 8:
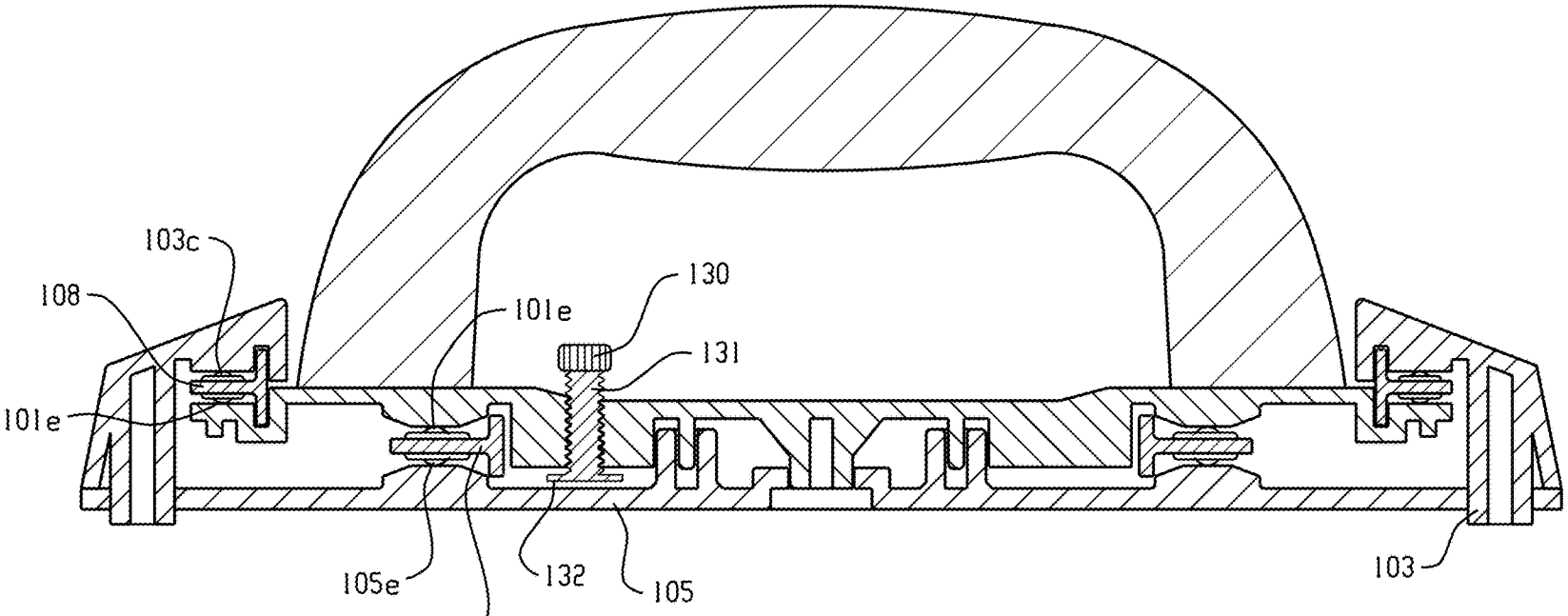
FIG. 8 depicts a cross-sectional view of an embodiment of the swivel handle comprising a threaded knob comprising a frictional pad, wherein the frictional pad may be moved toward the base plate to increase the friction on the base plate.

A swivel handle may comprise a tension or frictional control assembly that may be rotated in one direction to increase the friction between the rotational and stationary components and may be rotated in a second direction to decrease the friction between the rotational and stationary components. The tension control knob may be adjusted based upon personal preference or based upon the weight of the contents of the travel cover or luggage. An embodiment of a swivel handle comprising a frictional control assembly is shown in FIG. 8. In this embodiment, the swivel handle comprises a knob 130 connected to a threaded rod 131. The knob 130 may be rotated to press the foot 132 against the base plate 105 thereby reducing the ability of the handle 102 to rotate relative to the housing 103. The foot 132 may comprise felt or a felt-like material, a rubber pad, finger like elements or other element that allows incremental increases in friction as the foot 132 is pressed against the base 105. In addition to the embodiment shown in FIG. 8, the embodiment of the brake assembly shown in FIG. 7 may be modified to include a tension or friction control assembly by modifying the spring 121 biased button 120 with a threaded know that may be used to incrementally adjust the position of the arms 123 and thus the amount of friction against the underside 125 of the housing 103. The knob replacing the button could be turned in one direction to increase friction and the other direction to decrease friction between the rotational components and the stationary components. The tension or friction control assembly may also comprise other components such as, but not limited to, a belt and an adjustable pulley as is known in the art.

The swivel handle may further comprise a locking member with a twisting suspension. The twisting suspension may comprise a spring assisted counter wheels on the inside of the housing. An embodiment of the swivel handle has a locking member having a twisting suspension. In such embodiments, the locking member with a twisting suspension does not lock relative rotation of the handle relative to the housing. For example, with the handle is in a locked position, the travel cover may still partially rotate if it hits a bump. The handle may twist 10 degrees to 15 degrees without loss of control. Such partial rotation decreases the impact on the wrist of the user.

Figure 10:
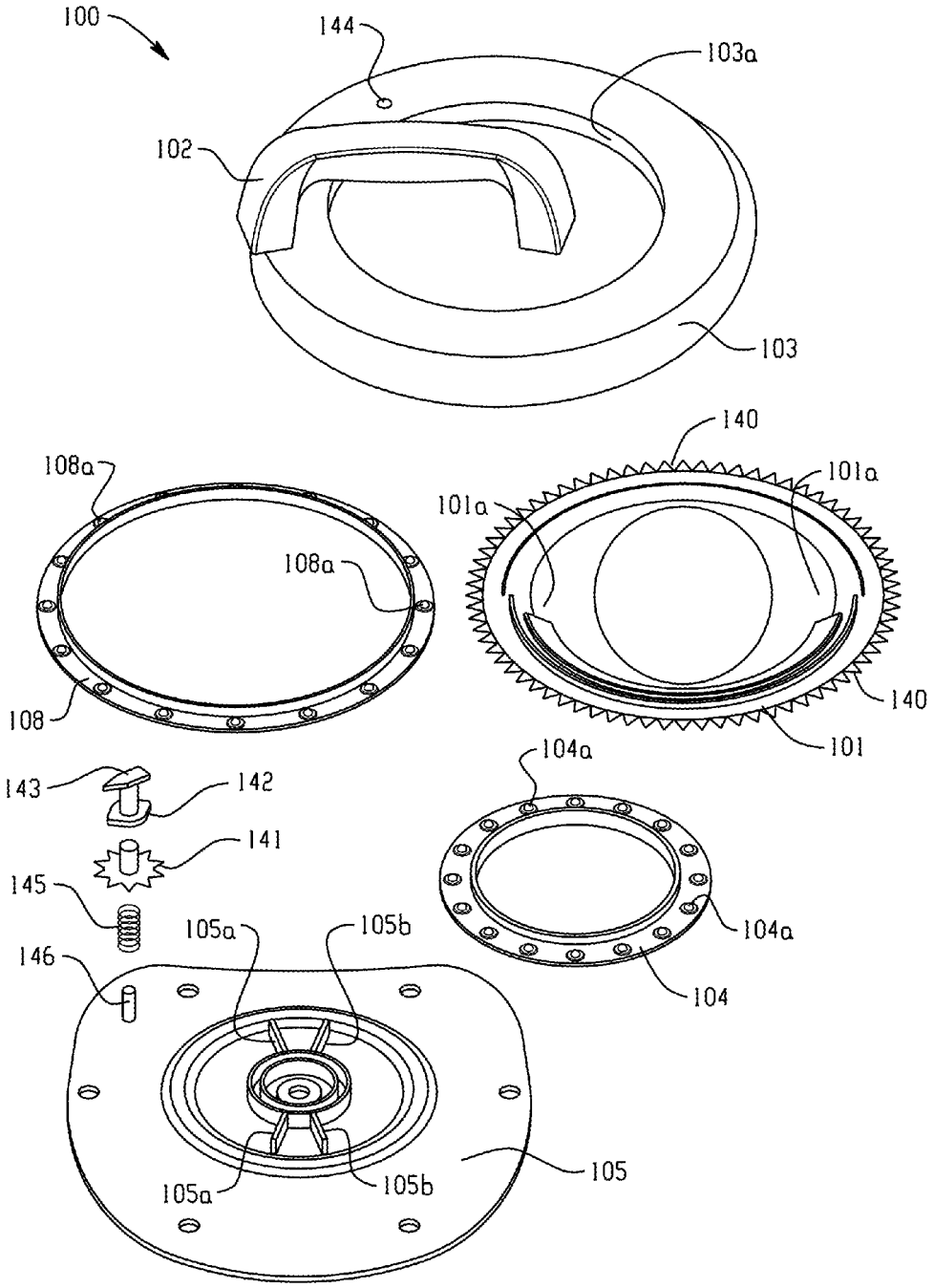
FIG. 10 depicts components of an embodiment of a travel cover comprising a locking assembly comprising a rotation suspension system capable of allowing partial rotation of the handle from an original position and a biasing member to return the handle substantially to the original position.

An embodiment of a locking mechanism with a biasing suspension mechanism allows the rotatable plate to rotate relative to the base plate from an original position to a rotated position and bias back to the original position. An embodiment of a locking mechanism with a biasing suspension mechanism is shown in FIG. 10. In this embodiment, the rotatable plate 101 comprises a plurality of recesses or detents 140 around the circumference of the plate 101. The detents 140 are capable of meshing with the locking gear 141. The locking gear 141 may be moved into engagement with the detents to lock the rotatable plate 101 in an initial locked position and handle 102 by rotation of cam 142 with cam handle 143. The housing 103 defines an aperture 144 so that the cam handle 143 may be accessible from outside the housing 103. Locking gear 141 may still partially rotate while in the locking position because it is rotatable mounted on a post 146, however, rotation of the locking gear 141 is limited by spring 145. Further, spring 141 biases the rotatable plate 101 and handle 102 back to the initial locked position.

Figure 12:
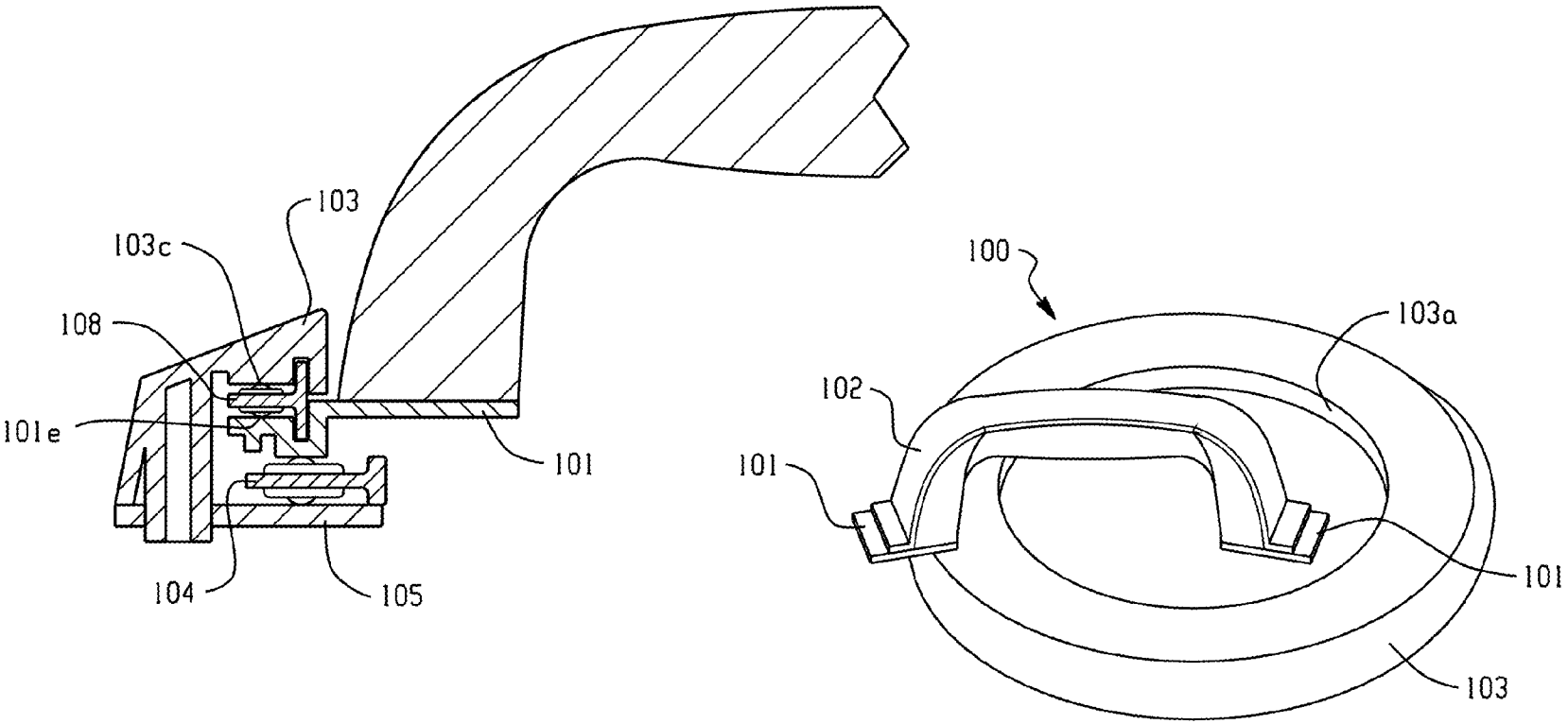
FIG. 12 depicts an embodiment of the swivel handle having a partial rotating plate and partial base plate.

A still further embodiment is shown in FIG. 12, this embodiment of the swivel handle 100 comprises a partial base plate 105 in the shape of an annular ring capable of being connected to an enclosure (not shown) and a rotatable plate 101 rotatable relative to the base plate 105. The rotatable plate 101 of this embodiment is in the shape of two tabs connected to the bottom of the handle 102 and extending under the housing 103. The handle 102 may be integral to the rotatable plate 101 or connected separately of the rotatable plate 101. The rotatable plate 101 may be disposed between and rotatable relative to housing 103 and the base plate 105. The rotatable plate 101 may rotate within the space between the base plate 105 and the housing 103. A bearing 108 may be disposed between the covered periphery portion of the housing 103 and an upper bearing surface of the rotatable plate 101. A second bearing 104 may also be installed between the base plate 105 and the rotatable plates 101. The bearings may take any desirable form including slide bearings and/or roller bearings. The roller bearings may be ball bearings or wheel bearings, for example.

Figure 13:
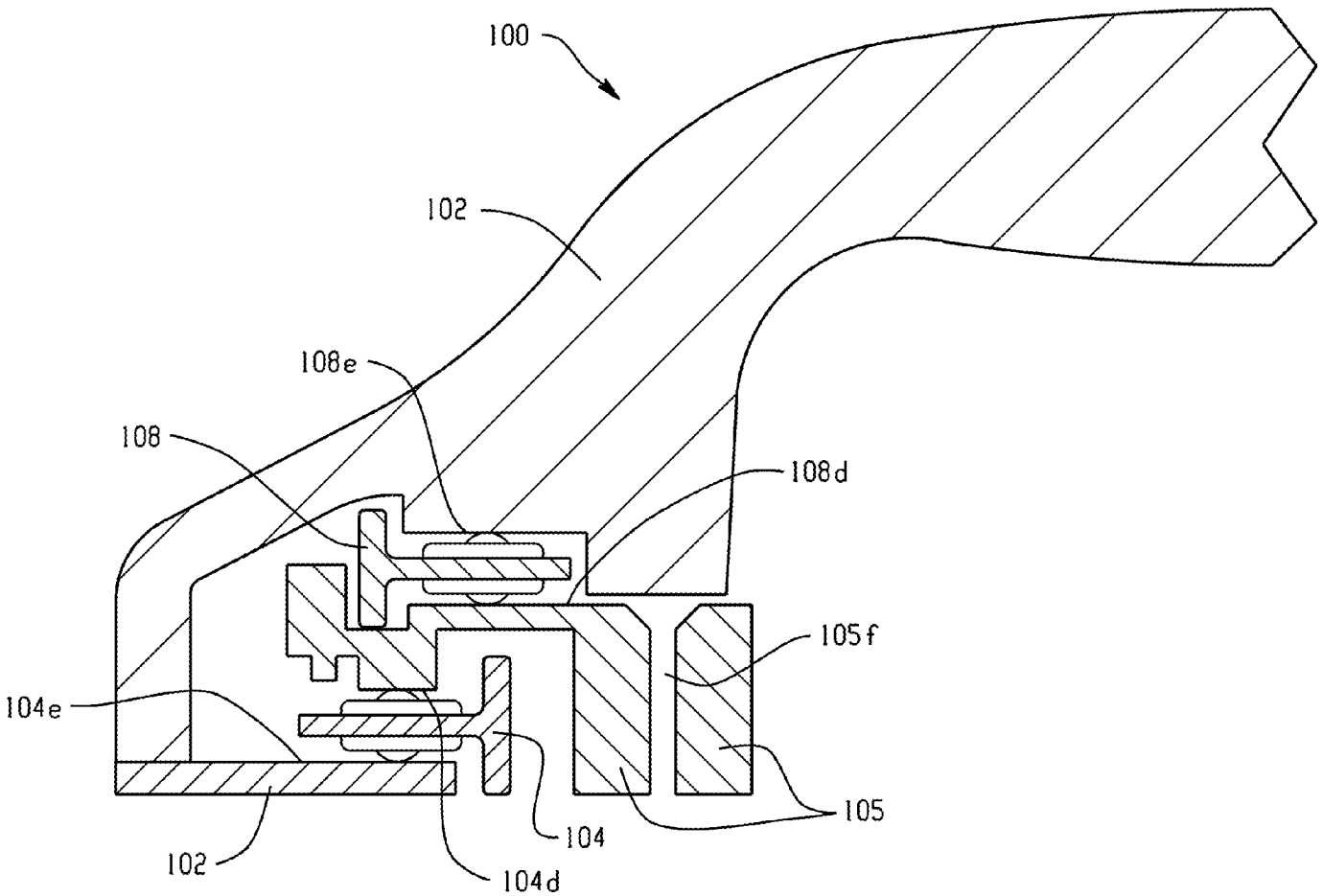
FIG. 13 depicts an embodiment of the swivel handle wherein the housing is incorporated into the handle and the handle/housing is rotational component of the swivel handle that rotates relative to the base plate.

A further embodiment is shown in FIG. 13, this embodiment of the swivel handle 100 comprises a combined handle and housing 102. The swivel handle may comprise a base plate connected an enclosure and a handle rotatably connected to the base plate, wherein the handle comprises a housing that covers the baseplate. The swivel handle this embodiment may further comprise an upper bearing 108 disposed between an upper bearing surface 108*d* on the base plate 105 and an upper bearing surface 108*e* on the housing 102. This embodiment may further comprise a lower bearing 104 disposed between an lower bearing surface 104*d* on the base plate 105 and a lower bearing surface 104*e* on the housing 102. The handle/housing 102 is a rotatable component. The embodiment of the swivel handle 100 comprises a base plate 105 but does not comprise a rotatable plate 101 as in the other embodiments. The base plate may be connected to the enclosure by a fastener extending through apertures 105*f*.

In the embodiment of FIG. 13, the handle/housing 102 wraps under underneath the base plate 105 to retain the handle/housing 102 on the base plate 105. The handle/housing 102 may comprise two components to allow easier assembly of the swivel handle of FIG. 13. The swivel handle of FIG. 13 may comprise two bearings, an upper bearing 10 and a lower bearing 104, disposed on either side. As in the other embodiments, the upper bearing 108 allows easy rotation of the handle 102 while pulling the wheeled travel cover. As previously defined, the term travel cover includes luggage.

The embodiments of the described methods and travel covers with at least one swivel handle are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A swivel handle, comprising:

a base plate;

a housing connected to the base plate;

a rotatable plate disposed between the housing and the base plate, wherein the rotatable plate is rotatable relative to the housing;

a handle connected to the rotatable plate; and a brake member, wherein the brake member is movably connected to one of the handle and the rotatable plate and moveable between a released position and a braking position, wherein the brake member is biased toward the released position and, in the braking position, the brake member contacts one of the base plate and the housing.

2. The swivel handle of claim 1, wherein the brake member is biased by a spring.

3. The swivel handle of claim 1, comprising a second brake member wherein the brake member is slidingly connected to the handle between a released position and a braking position, wherein the brake member is biased toward the released position and in the braking position the brake member contacts the housing.

4. The swivel handle of claim 1, wherein the base plate is connected to an enclosure.

5. The swivel handle of claim 1, wherein the brake member comprise two arms that contact the housing on both sides of the handle member in the braking position.

6. The swivel handle of claim 5, wherein the two arms comprise brake pads and in the braking position contact an underside of the housing.

7. The swivel handle of claim 6, comprising a brake button on the centrally located underside of grip portion of the handle.

* * * * *